United States Patent [19]

Veith et al.

[11] Patent Number: 4,728,049

[45] Date of Patent: Mar. 1, 1988

[54] DEVICE FOR LAYING-OUT A CONVOLUTE WEB OF MATERIAL

[75] Inventors: Gustav G. Veith; Götz U. Veith, both of Frasdorf, Fed. Rep. of Germany

[73] Assignee: Gustav Georg Veith GmbH & Co. KG, Fed. Rep. of Germany

[21] Appl. No.: 847,433

[22] Filed: Apr. 2, 1986

[30] Foreign Application Priority Data

May 31, 1985 [DE] Fed. Rep. of Germany ..... 3519590

[51] Int. Cl.[4] ..... B65H 16/10

[52] U.S. Cl. ..... 242/55; 242/66; 242/621 R; 242/68; 242/75.1

[58] Field of Search ..... 242/68, 55, 67.1 R, 242/67.4, 67.3 R, 65, 66, 75.1, 54 R

[56] References Cited

U.S. PATENT DOCUMENTS

| | | | |
|---|---|---|---|
| 2,670,907 | 3/1954 | Huck | 242/75.1 |
| 2,984,429 | 5/1961 | Huck | 242/75.1 |
| 3,834,638 | 9/1974 | Savage et al. | 242/75.1 X |

FOREIGN PATENT DOCUMENTS

| | | |
|---|---|---|
| 2128315 | 1/1976 | Fed. Rep. of Germany . |
| 1105531 | 3/1968 | United Kingdom . |
| 2024884 | 4/1982 | United Kingdom . |

*Primary Examiner*—David Werner

*Attorney, Agent, or Firm*—Darby & Darby

[57] ABSTRACT

A device is described for laying-out a convolute web of material, in particular a web of textile material, coming from a bale of cloth, said device comprising a frame structure which is adapted to be moved longitudinally along a stationary support structure and on which, via suspension means, the bale of cloth is supported such that it is caused to rotate about its winding shaft in response to the longitudinal movement of said frame structure. The drive means of the bale of cloth is constructed such that slippage between said drive means and said bale of cloth—which would prevent rotation of said bale of cloth—is avoided and that, with the aid of very simple structural means, a wide range of use of the device equipped with said drive means is achieved. For this purpose, the drive means comprises a tight rope, which, via guide rolls adapted to be displaced together with the frame structure, is guided over part of the surface of the bale of cloth in a position of frictional engagement.

25 Claims, 12 Drawing Figures

15
30
16
3
32
35
34
2
11b
11b
9b
8
13b
28
14b
27
5
4
13a
11'a
14a
10
9a
11a
1

5
5'
3
2
32
2
5
4
32

DEVICE FOR LAYING-OUT A CONVOLUTE WEB OF MATERIAL

FIELD OF THE INVENTION

The present invention refers to a device for laying out a web of material, in particular a web of textile material, coming from a bale cloth.

DESCRIPTION OF THE PRIOR ART

German Pat. No. 21 28 315. discloses the use of two frictional wheels, the frictional wheels being rotatably supported on a frame structure. The frictional wheels abut stationary runner rails on which the roll by frictional engagement therewith when the frame structure is moved in the longitudinal direction. In addition, the frictional wheels are in frictional engagement with the surface of the bale of cloth so that the bale of cloth is adapted to be rotated about its winding shaft in response to rotation of the frictional wheels. Depending on the direction of movement of the frame structure, the bale of cloth is either laid out or wound up. By means of a system of levers which has to be operated by hand, the frictional wheels are pressed against the bale of cloth with a high or not so high contact pressure. In view of the fact that the area of contact between the frictional wheels and the bale of cloth is, essentially, only punctiform, it may—in particular if the operation is carried out by unskilled operators—happen that the contact pressure between the frictional wheels and the bale of cloth is not sufficiently high so that slippage occurs between the bale of cloth and the frictional wheels, and said slippage may cause displacement or distortion of the uppermost winding of the web of textile material. This is, however, disadvantageous in particular in the case of delicate materials.

The present invention is based on the task of providing the disclosed device with a drive means, which prevents to a large extent slippage between the drive means and the bale of cloth and which, on the basis of a very simple structural design, provides a very wide range of use for the device in question. The device for winding or unwinding a web of material with respect to a winding shaft in accordance with the present invention comprises an elongated stationary support structure, a frame movable longitudinally with respect to the support structure, suspension means on the frame for supporting the winding shaft and driving means comprising guide rolls supported on the frame and rope means. The rope means is under tension and contacts the guide rolls and the web wound on the winding shaft. The rope means is adapted to being displaced in the direction of the circumference of the web when the frame is moved relative to the support means in order to rotate the wound web on the winding shaft for winding or unwinding the web.

The rope of the device according to the invention can contact an essentially larger surface area of the bale of cloth on the winding shaft, the contact pressure being applied at least along a line of contact. It follows that slippage can no longer occur. At this point, reference is made to the fact that the expression "rope" includes metal ropes having a circular cross-section as well as flat belts or bands.

In one embodiment of the invention the effect is that the rope is guided in an optimum manner, slippage being reduced to an even greater extent by means of the guide rolls which are in a position of frictional engagement.

Another embodiment guarantees, on the one hand, good contact between the guide rolls and the bale of cloth, but, on the other hand, said guide rolls can be removed from the bale of cloth in a simple manner if this is desired.

Special advantages are offered by the rope drive means according to the invention in one particular embodiment. In this arrangement it It is thus possible to reverse the driving direction of the drive means with the aid of means having a very simple structural design so that the bales of cloth, which are normally delivered in the same position, can be laid out with their right side facing upwards in one case and with their left side facing upwards in another case. Moreover, it is thus also possible to achieve, in a very simple manner, a zigzag layout of the material, and in this case an extremely exact superposition—which is required for the purpose of cutting out—is guaranteed due to the comparatively large area of driving contact between the rope and the bale of cloth.

A first preferred realization of the invention utilizes principle a rope which is held between two tensioning points and along which the device can be displaced.

Other preferred structural embodiments of this are encompassed by the invention principle.

An alternative embodiment of the drive means uses an endless rope which is secured to a frictional wheel.

Preferred structural embodiments of this principle.

A particularly preferred structural design with the aid of which the drive means can be turned in a simple is disclosed herein manner.

A particularly simple and expedient structural design of the suspension device for the bale of cloth, is described and claimed which, in combination with the rope drive means, permits rapid exchange of the bales of cloth and which, consequently, guarantees universal applicability of the device according to the invention.

Other embodiments substantially facilitate—with the aid of very simple structural means—a zigzag lay-out of a web of material.

In the following, embodiments of the invention will be explained in detail.

DESCRIPTION OF THE PREFERRED EMBODIMENTS

Figure 1:
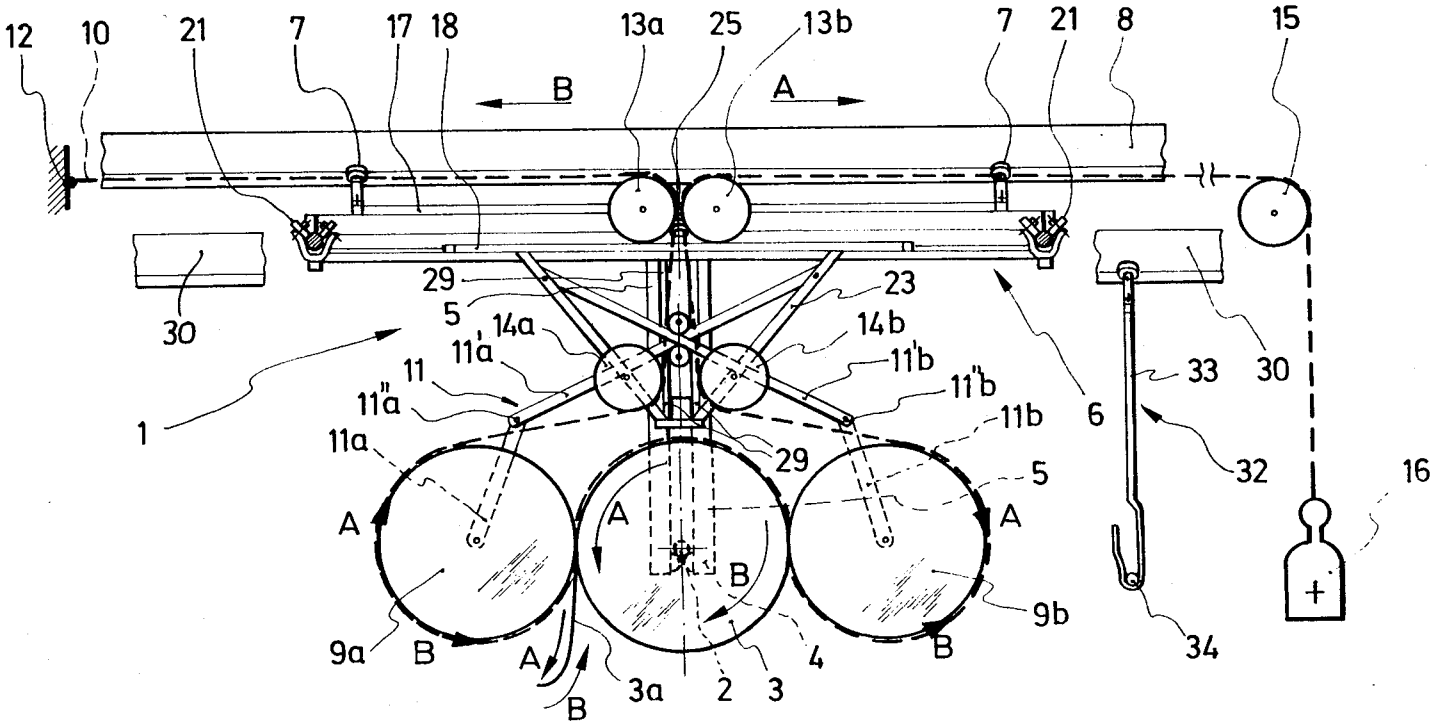
FIG. 1 shows a partially cut side view of a first embodiment of the invention
Figure 2:
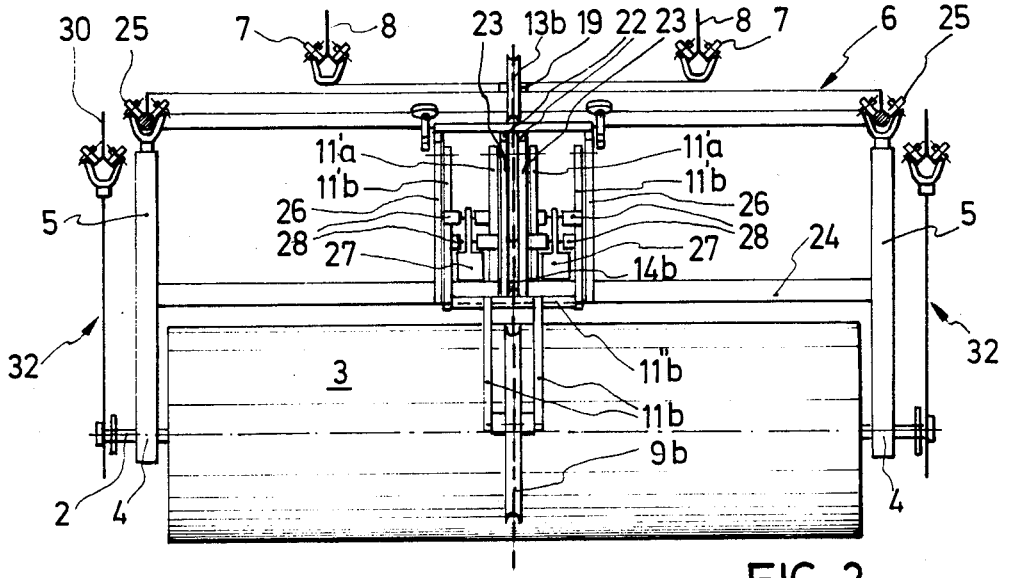
FIG. 2 shows the front view of the embodiment according to FIG. 1
Figure 3:
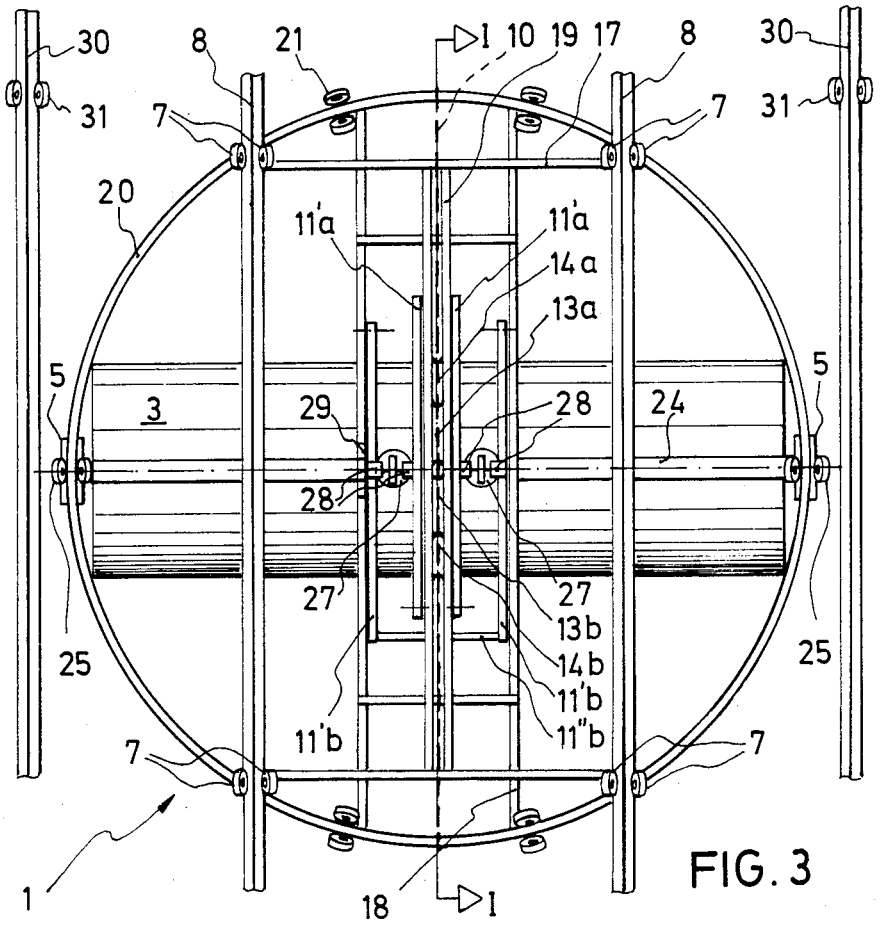
FIG. 3 shows the top view of the embodiment according to FIG. 1.

FIGS. 1 to 3 show different views of device for laying out a bale of cloth 3 which is wound onto a winding shaft 2, said device as a whole being provided with reference numeral 1. The winding shaft 2 projects beyond the bale of cloth 3 at both sides thereof and is at both sides supported in a bearing means 4 for rotatably mounting said winding shaft. The bearing means 4 is formed in the lower end of a suspension carrier 5 whose upper end is held by a frame structure 6. The frame structure 6 is provided with rollers 7 on the side facing away from the suspension carrier 5. With the aid of said rollers 7, the frame structure 6 and, consequently, the suspension carrier 5 and the bale of cloth 3 can be displaced along a supporting structure having the structural design of a pair of longitudinal rails 8. Said longitudinal rails 8 are arranged at the ceiling of the building such that they extend parallel to each other, horizontally and at such a height that the textile material of the bale of cloth 3 can be spread on a lay-out table which is not shown. The longitudinal rails 8 have an inverted Y-shaped cross-section, the rollers 7, which are arranged in pairs and which are connected by bow means, running on the underside of the legs of said cross-section. The rails, the rollers and the fastening of said rollers or rather the fastening of displaceable parts to said rollers are generally known so that they need not be described in detail.

For driving the bale of cloth 3, two guide rolls 9*a* and 9*b* and a rope 10 are provided. The guide rolls 9*a* and 9*b* are suspended on both sides of the bale of cloth 3 from a system of levers 11, which will be described hereinbelow, such that their axles extend parallel to the winding shaft 2 and that they are located in the plane of symmetry of the longitudinal rails 8. The system of levers 11 comprises on each side a freely swinging lever arm 11*a* and 11*b*, respectively, the free ends of said lever arms each having connected thereto the axle of a guide roll 9*a* and 9*b*, respectively. The lever arms 11*a* and 11*b* are arranged such that the axles of the guide rolls 9*a* and 9*b* are positioned on the same level with, or, preferably, on a slightly higher level than the winding shaft 2. Furthermore, said lever arms 11*a* and 11*b* extend away from the bale of cloth 3 at an oblique angle which is determined such that, due to their own weight, the guide rolls 9*a* and 9*b* will be in light frictional engagement with the bale of cloth 3 in the case of any diameter of said bale of cloth. The guide rolls 9*a* and 9*b* are constructed as wheels and their circumference is provided with a groove (FIG. 2) in which the rope 10 runs.

The rope 10 may either be a metal rope having a circular or an approximately circular cross-section or it may be a band or belt. One end of the rope 10 is fixedly anchored at 12. The anchoring point 12 can, for example, be a hook or a clamping means secured to the wall. The rope may, however, also be secured to a cross bracing of the longitudinal rails (not shown). The anchoring point 12 is arranged symmetrically between the longitudinal rails 8 and permits the rope 10 to be guided away in the plane of symmetry of the longitudinal rails 8 in the direction of movement of the device 1. Above the imaginary intersecting point of the plane of symmetry between the longitudinal rails 8 and of the winding shaft 2 the rope is deflected towards the bale of cloth 3. The deflection is effected by one of two additional guide rolls 13*a* and 13*b*, which are rotatably supported on the frame structure 6. The second guide rolls 13*a* and 13*b* are arranged in the plane of symmetry between the longitudinal rails 8 such that they are located one behind the other and circumferentially spaced from each other at a distance which exceeds only slightly twice the thickness of the rope 10 so that the point of deflection is positioned almost perpendicularly above the centre line of the winding shaft 2. Also the guide rolls 13*a* and 13*b* are constructed as wheels and are provided with a circumferential groove for guiding the rope 10 (FIG. 2).

The rope is then guided round the first tensions roll of a pair of tension and guide rolls 14*a*, 14*b* supported perpendicularly below the line of symmetry of the longitudinal rails 8 in a manner which will be described hereinbelow. After leaving the tension roll 14*a*, the rope 10 is guided round the first guide roll 9*a*. After leaving the first guide roll 9*a*, the rope runs over the surface of the bale of cloth 3 facing the rails and arrives at the guide roll 9*b* on the other side, and from said guide roll 9*b* it runs via the tension roll 14*b* to the second guide roll 13*b*. After leaving the second guide roll 13*b*, the rope is again guided in the middle between the longitudinal rails 8 up to the end, where an additional guide roll 15 is provided, said guide roll 15 being also constructed as a wheel which has provided a groove in the circumference thereof. The rope 10 is guided round the guide roll 15 and the free end of said rope has attached thereto a tensioning device 16 in the form of a weight. The weight is provided with such a structural design that the rope has imparted thereto a tension sufficient for friction transmission, but is prevented from exerting on the bale of cloth a pressure which would be strong enough for entailing a risk of damage to the textile material.

In the position shown, the rope 10 is drawn in the direction of arrow A over the guide rolls 9 and the bale of cloth 3 when the frame structure 6 is displaced along the longitudinal rails 8 in the direction of arrow A, the bale of cloth 3 being, in the course of this process, moved in the direction of arrow A and a web of material 3*a* being deposited on the lay-out table in the direction of arrow A. When the frame structure 6 is being displaced in the direction of arrow B, the rotary movements take place the other way round so that the rotary movements referred to by B will take place; hence, the web of material 3*a* is wound up again.

Figure 4:
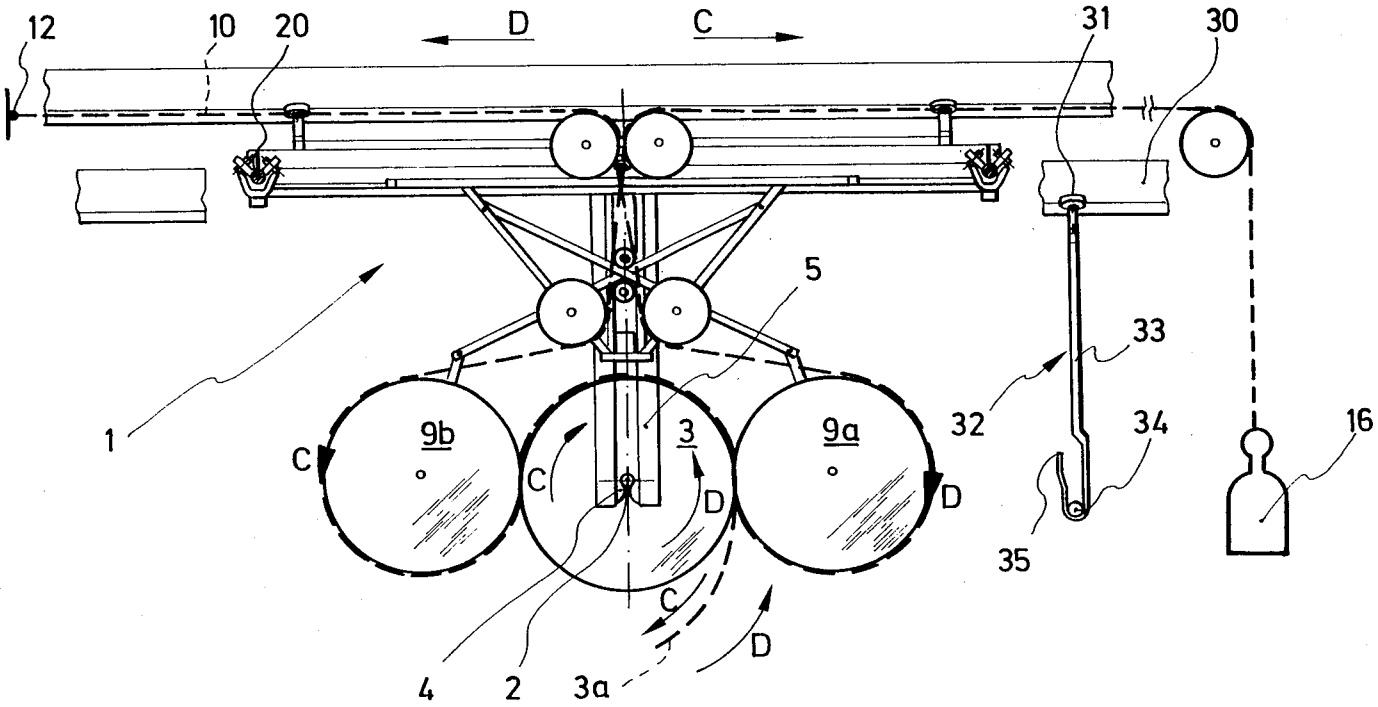
FIG. 4 shows a view of a first embodiment which corresponds to the view according to FIG. 1 but employs the opposite direction of drive.

If it is desired to unwind the material also in the case of a backward movement of the device 1 (in the direction of arrow B), parts of said device 1 are turned in the manner described hereinbelow so that the crosswise arrangement of the rope 10 indicated in FIG. 4 is obtained. FIG. 4 shows the same device 1, which is shown in FIGS. 1 to 3.

For the purpose of crossing the rope 10, the frame structure 6 is provided with a first frame 17 and a second frame 18. The first frame 17 consists of rectangularly combined frame struts having attached the rollers 7 to their respective corners. A two-piece intermediate strut 19 extends along the plane of symmetry between the two longitudinal rails 8, the guide rolls 13*a* and 13*b* being supported in said intermediate strut by known bearing means used for rotatably mounting said guide rolls. The side of the the first frame 17 facing away from the longitudinal rails 8 has secured thereto a rail means 20 having the shape of a circular arc. For constructional reasons, the travelling path section of the rail means 20 is provided with a round cross-section, and said rail means 20 is welded to the first frame 17 via a narrow web projecting centrally upwards. It is a matter of course that also any other rail cross-section may be used, provided that the cross-section is suitable for a circular-arc rail. Inclined rollers 21, which are arranged in pairs and the structural design of which essentially corresponds to that of the rollers 7, run on the upper side of the circular-arc travelling path section of the rails means 20. Said rollers 21 carry the second frame 18 consisting again of rectangularly combined frame struts. Below the two-piece intermediate strut 19 of the first frame 17 an intermediate strut 22 is provided at said second frame 18, said intermediate strut 22 consisting of two pieces as well and being congruent with said intermediate strut 19. The intermediate struts 22 have secured thereto identically designed trapezoid carriers 23 on both sides of the plane of symmetry between the longitudinal rails 8. The side of the trapezoid carriers 23 facing away from the second frame 18 rests on a crossbar 24. The crossbar 24 is arranged above the bale of cloth 3 such that its axis extends parallel to the winding shaft 2 and it is fixedly connected to the suspension carriers 5. The suspension carriers 5 are also provided with roller pairs 25 which are arranged on the side facing away from the gripping means 4 and which are in rolling contact with the circular rail means 20. The additional tension and guide rolls **14*a* and 14*b* are supported in conventional bearing means for rotatably mounting such rolls between the inner trapezoid carriers 23. Furthermore, the outer longitudinal struts of the second frame 18 have attached thereto identically designed outer trapezoid carriers 26, which, too, rest on the crossbar 24. A displacement means, e.g. in the form of an only schematically shown lift cylinder 27, is provided on both sides of the plane of symmetry in the interspace between the respective inner and outer trapezoid carriers 23 and 26. The lift cylinders 27 may preferably be designed as hydraulic cylinders whose structural design is sufficiently known (the lift cylinders have been omitted in the side elevations for reasons of clarity). The pistone of each lift cylinder 27 carries four rotatable pressure rollers 28. The axes of rotation of the pressure rollers 28 extend parallel to the winding shaft 2, and two respective pressure rollers 28 at opposite sides being arranged coaxially with each other. The respective coaxial pairs of pressure rollers are arranged such that one is disposed perpendicularly below the other and they receive between them a second pivotable lever 11*a*' and 11*b*', respectively, of the system of levers 11. The second pivotable levers 11*b*' of the second guide roll 9*b* are articulated on the inner sides of the outer trapezoid frames 26 in the vicinity of the second frame 18 and the free ends of said levers are connected to an axle 11*b*'' which has articulated thereon, in a freely rotatable manner, the freely pivotable levers 11*b* with the axle of the guide roll 9*b* (FIG. 2). The second pivotable levers 11*a*' of the guide roll 9*a* are articulated on the outer sides of the inner trapezoid frames 23 in the vicinity of the second frame 18, and the free ends of said levers are provided with an axle 11*a*'' (not shown for reasons of clarity), said axle 11*a*'' being, however, shorter than the axle 11*b*'' in view of the smaller distance at which the inner trapezoid frames 23 are spaced from each other. The axle 11*a*'' has articulated thereon in an analogous manner the free pivotable levers 11*a* for the axle of the guide roll 9*a*. Within the outer trapezoid frames 26, a guide means 29 for the pressure rollers 28 is provided, said guide means comprising two oppositely disposed struts, which are spaced apart at a distance corresponding to the diameter of the pressure rollers 28 and which extend in the vertical direction between the crossbar 24 and the second frame 18. The running surfaces for the pressure rollers 28 are provided on the inner sides of the two struts facing each other. Such guide means may also be provided, in the same manner, at the inner trapezoid frames 23**.

In order to obtain the position shown in FIG. 4, the second frame 18 plus all the members secured to said second frame 18 are turned by 180° relative to said first frame 17 and the members secured to said first frame 17. The only parts remaining with the first frame in the position shwon in FIG. 1 are the second guide rolls **13*a* and 13*b* as well as the circular rail 20. On said circular rail 20, the second frame 18 is turned together with the carriers 5 plus the winding shaft 2 and the bale of cloth 3, the trapezoid frames 23 and 26 plus the guide rolls 14*a* and 14*b* supported in said trapzoid frames as well as the system of levers 11 plus the first guide rolls 9*a* and 9*b*. This has the effect that the rope 10 is crossed at a short distance below the guide rolls 13*a* and 13*b*, the small distance between the two guide rolls 13*a* and 13*b* guaranteeing that the rope is prevented from leaving the circumferential grooves of the guide rolls. In accordance with an expedient embodiment, locking means, e.g. clamping levers, (not shown) are provided so that the preselected positions of the first and second frames can be secured relative to each other In this position, the directions of movement characterized by arrows C and D are obtained, the direction of movement C of the frame structure 6 in FIG. 4 corresponding to the direction of movement A of the frame structure 6 in FIG. 1. In this connection, a noteworthy fact is that the direction of rotation of the bale of cloth has been reversed. Since, however, the bale of cloth has been turned round as well, the material 3*a* will in this case, too, be unwound from the bale of cloth when a movement in direction C is taken place; only that the second surface of the bale of cloth is now directed outwards. Hence, if—as is usually the case—the material 3*a* is wound onto the bale of cloth 3 such that its left side faces outwards, the material 3*a* can be spread and wound up with its left side facing upwards in the position shown in FIG. 1 and it can be spread and wound up with its right side facing upwards in the position shown in FIG. 4, and in each case the frame structure can be displaced in the same direction shown in FIGS. 1 and 4** for the purpose of laying out and winding up the material.

Figures 5, 6A, 6B, 6C:
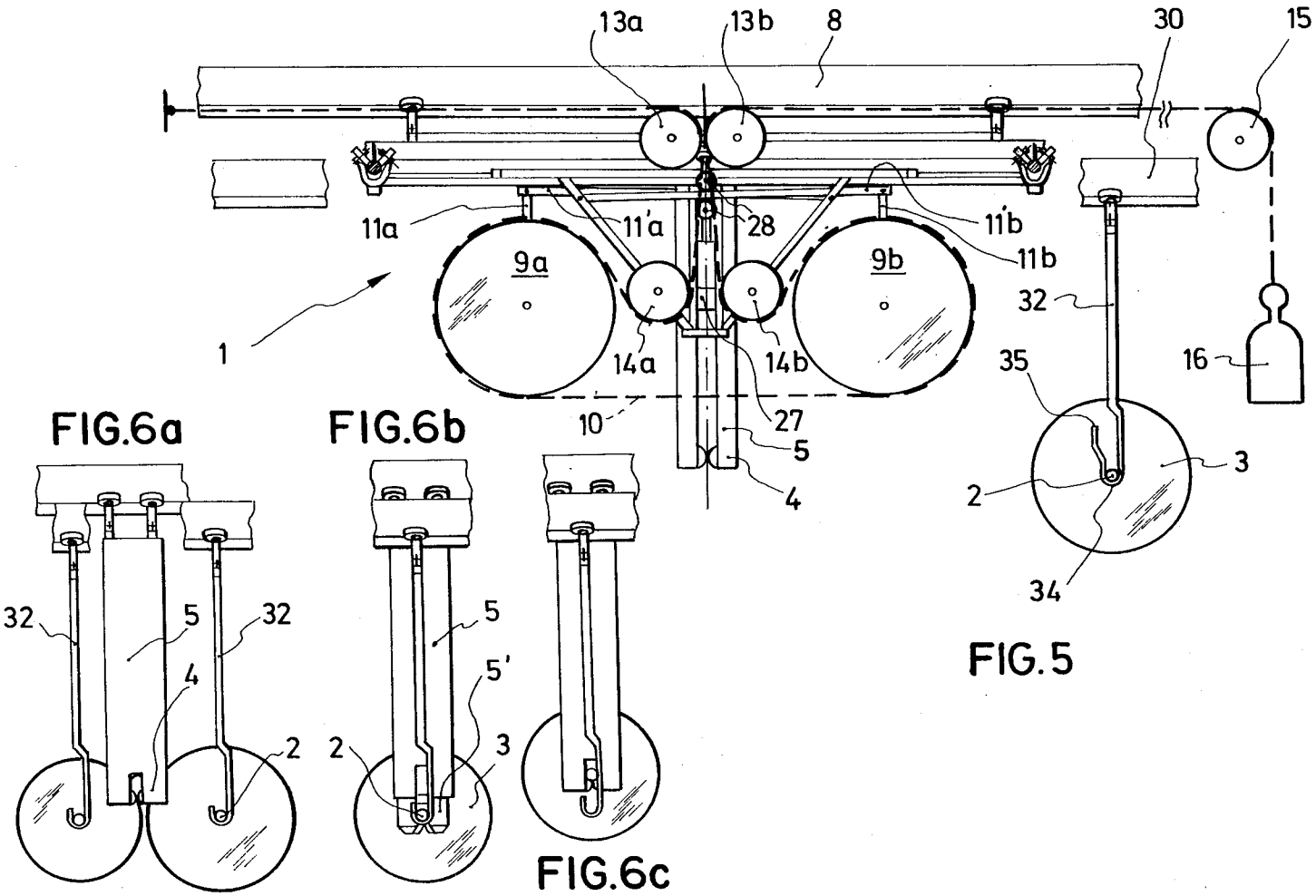
FIG. 5 shows the embodiment according to FIG. 1 without any bale of cloth.
FIGS. 6*a* to *c* show the sequence of actions during loading and unloading of the device according to the invention.

Additional possibilities of laying out the web of textile material as well as loading and unloading of the device 1 are explained by additionally referring to FIGS. 5 and 6.

A second pair of longitudinal rails 30 (FIG. 3) is arranged outside of the device 1, said second pair of rails 30 extending parallel to the pair of rails 8 and on both sides of said device 1 (FIG. 3). At least one trolley 32 runs on each of the rails of said pair of longitudinal rails 30 by means of rollers 31 of the type which has already been described. Each trolley 32 is provided with a vertical holding rod 33, which is adapted to be pivoted transversely as well as longitudinally with regard to the associated longitudinal rail 30. The free end of the holding rodd 33 has attached thereto a hook 34 defining a point of support for receiving the winding shaft 2. The point of support of the hook 34 is arranged slightly below the normal point of support of the winding shaft 2 in the gripping means 4 in the carrier 5. The free end 35 of the hook 34 is slightly longer than the distances between the points of support of the winding shaft 2 in the hook 34 and in the carrier 5 and, consequently, it projects a little beyond the winding shaft. In order to facilitate loading, the reception opening of the hook 34 is a little enlarged in comparison with the point of support.

For the purpose of loading the device 1 with a bale of cloth 3, the trolleys are displaced such that they are located in front of or behind the device and the winding shaft of a bale of cloth is attached. An expedient measure would, however, be to arrange in front of and/or behind the lay-out table a magazine for keeping in stock several trolleys which have already been provided with bales of cloth.

Prior to the loading operation, the first guide rolls 9*a* and 9*b* are pivoted upwards. For this purpose, the hydraulic cylinder 27 is extended, in the course of which process the levers 11*a'* and 11*b'* are displaced upwards between the respective pressure rollers 28 while entraining the free pivotable levers 11*a* and 11*b* and the guide rollers 9*a* and 9*b*. In accordance with an expedient embodiment, there is provided a stop means for the cylinder displacement, said stop means stopping the upward movement of the guide rolls 9*a* and 9*b* at a position at which a bale of cloth can easily be passed below said guide rolls. The next step is either that the device 1 with the grip-means 4 is displaced until it is located above the winding shaft 2 of the bale of cloth 3 to be taken up, or that the trolleys 32 with the bale of cloth 3 to be taken up are displaced until they are located below the gripping means 4 of the device 1. In the course of this process, the suspension carriers 5 are brought into engagement with the space between the respective trolley 32 and the bale of cloth 3.

As will be most clearly evident from FIG. 6*b*, the gripping means 4 is attached to a suspension carrier member 5' which can be extended from the suspension carrier 5 after the fashion of a telescope. The drive is expediently effected via lift cylinders (not shown for reasons of clarity) which are arranged in the interior of the suspension carriers 5. However, in this case, too, it would also be possible to use electric drive means or some other type of drive means. The member 5' is extended as soon as the gripping means 4 is located precisely perpendicularly above the winding shaft 2 of the bale 3 to be taken up. While the member 5' is being extended, the gripping means 4 moves, in a manner which will have to be described hereinbelow, over the winding shaft 2 and takes said winding shaft up. When the member 5' is displaced upwards, the winding shaft is lifted off the hook 34 and up into the lay-out position, as shown in FIG. 6*c*. The vertical displaceability of the member 5' can be selected such that it is sufficient for removing by means of the device 1 a bale of cloth from the middle of a magazine of bales of cloth which are disposed one behind the other, for which purpose it will be necessary to lift the removed bale of cloth over the preceding bales of cloth.

Reference is made to the fact that, in FIG. 6, a hook 34 is used which has a shorter free end 35. When the winding shaft 2 is being removed from a hook having such a structural design, the trolleys 32 are released and can be transported back.

Unloading of the device 1 is carried out in the reverse order.

For laying out the web of textile material coming from a single bale 3 in a zigzag arrangement, trolleys having lengthened free ends 35 are used, such trolleys being shown e.g. in FIG. 5. It will be expedient when the bale of cloth 3 is already taken over from a trolley of this type. When the winding shaft is being lifted off the hook 34, the free end 35 is not released from the winding shaft and, consequently, it will be dragged along when the device 1 moves along the rails 8. In this way, a first web of textile material is—e.g. in the position according to FIG. 1—spread on the lay-out table such that the left side faces upwards. At the end of the lay-out table, the bale of cloth is deposited, in the manner which has already been described, in the trolleys which have been dragged along. Subsequently, the guide rolls 9*a* and 9*b* are pivoted upwards to the positon shown in FIG. 5 and the second frame 18 is turned by 180°. The guide rolls 9*a* and 9*b* are lowered again, which has the effect that the rope 10 is again placed onto the surface of the bale of cloth 3. The member 5' of the suspension carrier 5 including the gripping means 4 is extended, takes hold of the winding shaft 2 and moves said winding shaft again into the layout position. It follows that the bale of cloth 3 still occupies the position shown in FIG. 1, whereas the drive is effected in the direction shown in FIG. 4. Hence, further unwinding is effected while the device 1 is being moved back along path D; however, this time unwinding is effected such that the right side faces upwards. This operation can be repeated until the necessary number of layers has been obtained. Subsequently, the trolleys 32 which have been dragged along are pivoted away from the bale 3 in a direction transversely to the rail 30, the winding shaft 2 is removed and the device 1 is loaded with a new bale.

However, laying out in a zigzag arrangement can also be achieved by another structural design of the device 1, which is not shown. In the case of this structural design, the carriers 5 are not supported such that they can be turned on the circular rail 20 nor are they fixedly connected to the second frame, but said carriers are arranged such that they are either only releasably connected to the second frame or fixedly connected to the first frame. In this case, it will be expedient to design the carriers 5 long enough to permit turning round of the guide rolls 9*a* and 9*b* with the system of levers 11 above the bales, whereby the rope will be crossed so that the same effect which has been described hereinbefore is achieved; the bale of cloth 3 can, however, remain in its support in the suspension arms 5.

Figure 7:
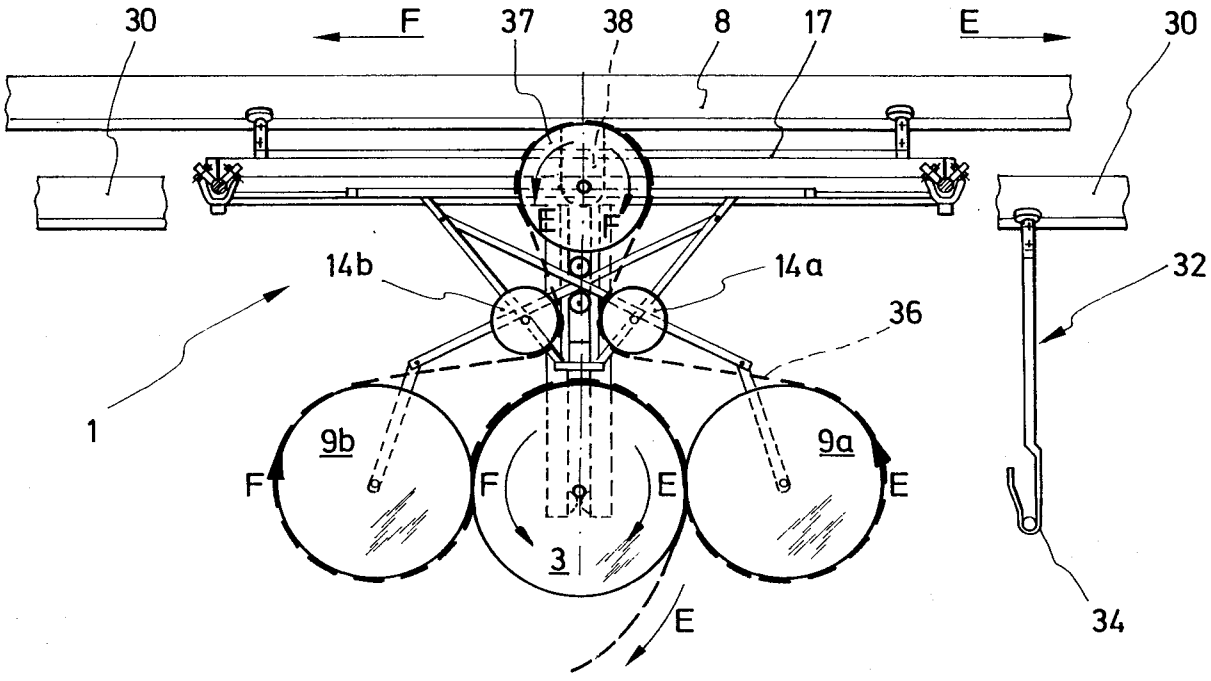
FIG. 7 shows a second embodiment of the invention.

FIg. 7 shows an additional embodiment of the invention, identical or comparable structural components being provided with the same reference numerals and being not described again. The second embodiment differs from the above-described embodiment by the use of an endless rope 35 instead of the continuous rope 10 and by the use of a frictional wheel 37 instead of the guide rolls 13*a* and 13*b* provided on the first frame 17. The frictional wheel 37 is arranged in the plane of symmetry between the longitudinal rails 8 and is fixedly connected to the two-piece intermediate strut 19 of the first frame 17 via a two-piece carrier member 38 in which the axle of the frictional wheel 37 is rotatably supported. The circumference of the frictional wheel 37 has provided therein a reception groove for the rope 36 in the manner which has already been described hereinbefore and carries one of the conventional friction linings, e.g. rubber, which improve the frictional engagement between the rope 36 and/or a runner rail, which is not shown in the drawing for reasons of clarity. The runner rail is arranged between the longitudinal rails 8 such that it is in contact with the frictional wheel 37 and it is provided with an e.g. inverted T-shaped cross-section, the frictional wheel 37 being in rolling contact with the underside of the transverse leg. The rope 36 runs from the frictional wheel 37 via the roll 14*b*, and then, in the manner described, via the guide roll 9*b*, the surface of the bale of cloth 3 and the guide roll 9*a* as well as via the guide roll 14*a* back to the frictional wheel 37. In accordance with an expedient embodiment, at least one of the two rolls 14*a* and 14*b*, respectively, are designed as tension rolls, which, e.g. due to the fact that their displaceably arranged axles are spring-loaded, quarantee that the rope 36 is always tensioned such that there is frictional engagement between the rope 36 and the frictional wheel 37 as well as between the rope 36 and the surface of the bale of cloth 3. When the device 1 is being displaced along the longitudinal rails 8, the frictional wheel 37 rolls along its runner rail and entrains the rope 36 in its rolling motion. This has the effect that the consequential movements referred to by reference sign E take place, said movements taking place the other way round when the device 1 is being displaced in the direction of arrow F. Attention should be paid to the fact that, if in the case of the embodiment according to FIG. 7 the device 1 is displaced in the same direction as in FIG. 1, the resultant consequential movements will take place the other way round.

Also this embodiment offers the possibility of reversing the direction of the consequential movements by crossing the rope 36. For this purpose, the second frame is turned away below the stationary frictional wheel 37, whereby the point of crossing is obtained directly below the frictional wheel. In this position, the directions of consequential movements shown in FIG. 1 are obtained when the device is being displaced along the arrows E and F. In the case of this embodiment, too, parallel rails 30 with additional trolleys 32 can be provided, loading and unloading of the device 1 and the measures taken for a zigzag layout being the same as in the case of the first embodiment.

Figure 8:
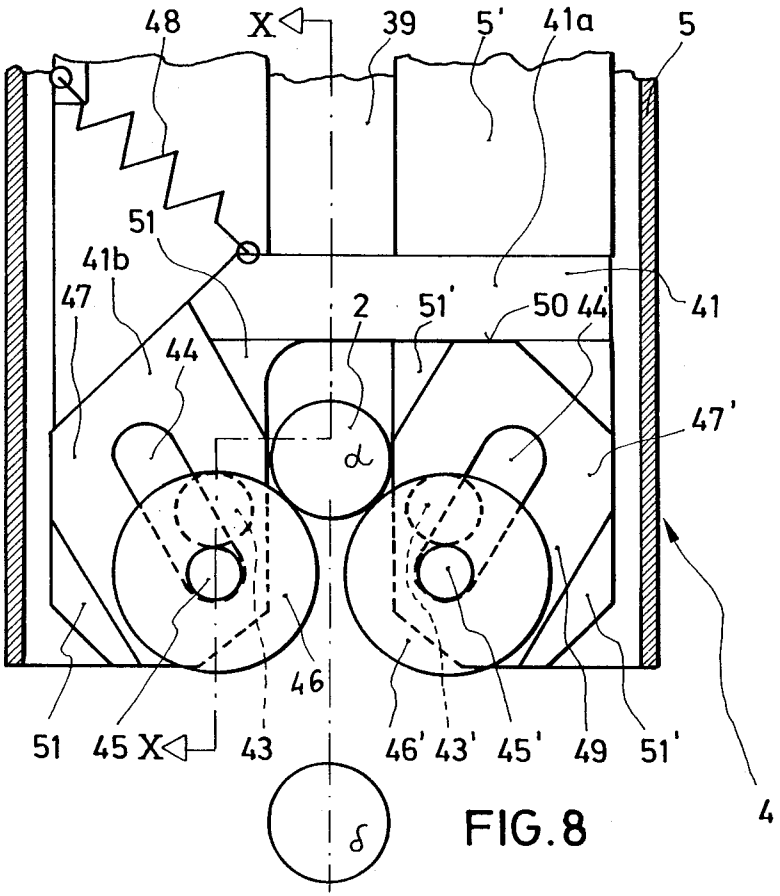
FIG. 8 shows a sectional view of the gripping means in its closed condition.
Figure 10:
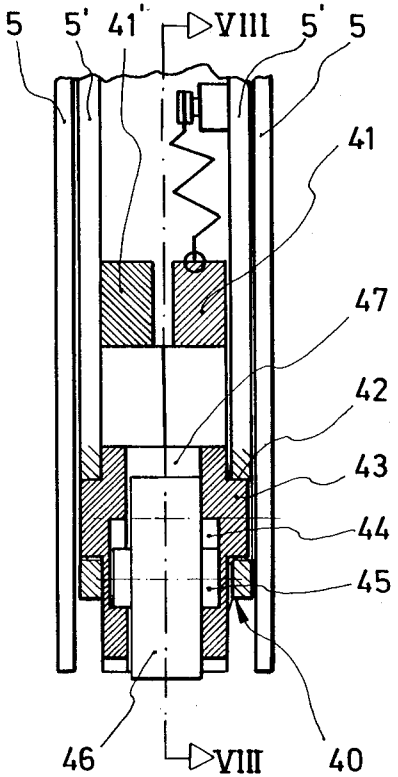
FIG. 9 shows a sectional view of the gripping means during bale exchange and FIG. 10 shows the section X—X of FIG. 8.
Figure 9:
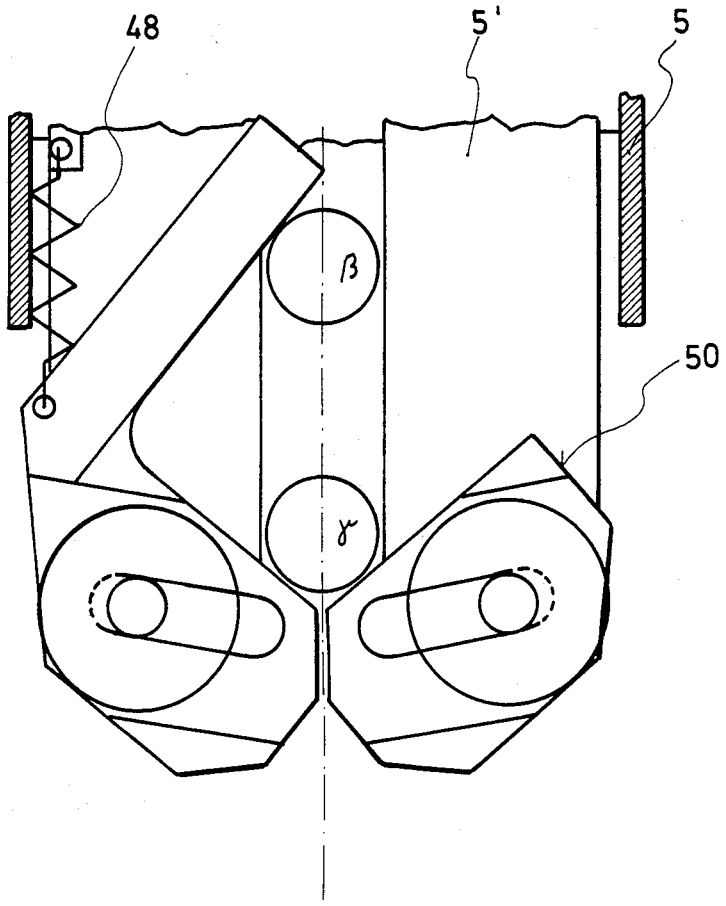

On the basis of FIGS. 8 to 10, the gripping means 4 will now be described in detail. The gripping means 4 have identical structural designs in the case of both suspension carriers 5 so that only a single gripping means will be described hereinbelow. FIG. 8 shows a longitudinal section through the lower, free end of one of the suspension carriers 5. The suspension carrier 5 is designed as a U-section symmetrically on both sides of the winding shaft 2 to be received, the U-sections being arranged such that their cavities face each other and that they extend at a distance from each other which is large enough to permit passage of the winding shaft 2. The carrier 5 may just as well have the structural design of a box-shaped profile, said box-shaped profile having provided therein from below a slot of sufficient width. In the interior of the profile of the suspension carrier 5, a member 5' is arranged which is adapted to be extended beyond the suspension carrier 5 after the fashion of a telescope. The structural design of members which are guided one within another after the fashion of a telescope is known to the person skilled in the art and need not be explained in detail. The extendable member 5' consists e.g. also of U-sections, or of four mutually spaced-apart struts, or of a solid material, or of a box-shaped profile, said box-shaped profile having provided therein from below a slot 39 for receiving therein the winding shaft 2 as well as a slot 40 for receiving therein the gripping means 4, said slot 40 extending centrally, at right angles to the slot 39 and also through the entire member 5'. The gripping means 4 comprises two identically designed bent levers 41 and 41', which are rotatably supported in struts of the member 5' by means of a pivot 43 (43' not shown) engaging a hole 42 in said member 5', said struts being arranged diagonally to each other. Each bent lever 41 comprises a first lever arm 41*a* extending horizontally in a first position and a second lever arm 41*b* extending essentially at right angles to said first lever arm. The lever arm 41*b* is provided with the pivot 43 and, at the side facing away from the pivot 43, it is provided with an elongate opening 44. An axle 45 is displaceably supported in said opening 44. Said axle 45 carries a roll 46 adapted to be rotated either about the axle 45 or with said axle in the elongate opening 44. The elongate opening extends from a lower limit, at which the centre line of the axle 45 is positioned essentially perpendicularly below the centre line of the pivot 43, at an oblique angle upwards and outwards away from the winding shaft 2. The angle included by the centre line of the elongate opening 44 and by the vertical centre line extending through the winding shaft 2 is approx. 35° to 60°, preferably 40° to 45°. The opening 44 is arranged in a guide path 47, which is provided in the form of a recessed surface in the lever arm 41*b* and the boundaries of which extend parallel to the elongate opening 44, said guide path 47 having a width which slightly exceeds the diameter of the roll so that said roll 46 can rotate without hindrance when displaced along the opening 44. The guide path 47 has a depth exceeding only slightly half the width of the roll 46. Outside of the centre line of the pivot 43 a helical spring 48 is articulated on the lever arm 41*a*. The articulation can be effected, in the manner known, by an incorporated or screwed-on loop or a through-hole. The other end of the spring 48 is, in an expedient manner, connected to the strut of the member 5' which also supports the pivot of the respective bent lever 41. The fastening can, for example, be effected by means of attachment to a screw which has been screwed into the base.

The respective other struts of the member 5', which extend diagonally as well, but which are not provided with said bent levers 41, have provided thereon rotary plates 49 which are designed in the same manner as the lever arm 41*b* of the bent lever 41. Also said rotary plates 49 are provided with a pivot 43', which is in alignment with the pivot 43, and with an elongate opening 44' in which the axle 45' of a second roll 46' is received such that it is displaceable therein. The opening 44' is incorporated in a guide path 47' in an analogous manner. The rotary plate 49 is provided with a stop surface 50 for the lever arm 41*a* of the bent lever 41, said stop surface being located at the top in the position shown in FIG. 8. In addition, the lever arm 41*b* and the rotary plate 49 are provided with suitably designed contact surfaces 51 and 51', respectively, which, when the device is being assembled, are brought into contact with correspondingly designed contact surfaces of the countermember. However, the bent levers and rotary plates, which are disposed opposite one another and which are used for the purpose of guiding a roll 46, can also be fastened by means of screws. The contact surfaces 51 prevent tilting of the respective parallel members and they prevent the rolls 46 and 46', respectively, from becoming wedged.

The gripping means 4 operates as follows:

FIG. 8 shows a winding shaft 2 in the gripping means 4 in a lay-out position $\alpha$. In said position $\alpha$, the winding shaft 2 is supported by the rolls 46 and 46', respectively, which act as a bearing means for rotatably supporting said winding shaft and the axles 45 and 45' of which are in a position of contact with the lower boundaries of the elongate openings 44 and 44', respectively. Due to the weight of the bale of cloth and of the winding shaft, the rotatable rolls 46 and 46' are held in this position, the bale of cloth 3 being thus taken up in a reliable manner. If the winding shaft 2 is to be removed from the gripping means 4, the first step is that the extendable member 5' is extended downwards beyond the suspension carrier 5 until the winding shaft 2, which rests in the hooks 34 of the trolleys 32, has moved—while entraining the bent levers 41 and the associated rotary plates 49—to position $\beta$. When this movement takes place, the elongate openings 44 are rotated to an almost horizontal position, which has the effect that the rotatable rolls 46 are already slightly displaced from their lower positions in said openings 44. The lower parts of the lever arms 41*b* and of the rotary plates 49 project into the carrier slot 39 up to a point at which they are almost in contact with each other. During the movement in question, the helical spring 48 exceeds its dead point and slackens again, said helical spring still holding the bent lever 41 in the position, which originated from said position $\beta$, when the winding shaft 2 has moved to position $\gamma$ due to the upward displacement of the member 5'. In said position $\gamma$, the winding shaft 2 first exerts a pressure on the rotatable rolls 46 and 46', which will evade this resistance by a displacement of their axles 45 within the openings 44 and open the passage. In said position $\gamma$, the winding shaft 2 additionally exerts a pressure on the bent levers and rotary plates 49 projecting into the carrier slot 39 so that the parts of the gripping means 4 will snap back into the position shown in FIG. 8; the winding shaft 2, however, has already moved downwards to such an extent that it is released from the gripping means 4. If an additional winding shaft located in position $\delta$ (FIG. 8) is to be taken up, the member 5' is extended until the rotatable rolls have been displaced—due to their contact with the winding shaft 2—to a position within the openings 44 in which they fully open the slot 39. When the winding shaft 2 is again located in position $\alpha$, the rotatable rolls are released from the winding shaft 2 and—due to their own weight—they drop back into the arresting position at the lower end of the opening 44.

The invention is not limited to the embodiments described and shown hereinbefore. For example, the rope can also be crossed with the aid of a bearing means. It is not absolutely necessary to construct the guide rolls 9 such that they are in frictional engagement with the bale of cloth 3, provided that it is guaranteed that the frictional force which is applied to the bale of cloth by means of the rope is sufficiently high. The system of levers can be replaced by any other type of suitable pivoting devices or vertical adjustment devices. Furthermore, additional guide and tension rolls may be provided. The weight can be replaced by another known tensioning device, e.g. by a pin which is adapted to be screwed into a sleeve. It is not absolutely necessary that the device is adapted to be displaced in a position in which it hangs from longitudinal rails, but it may just as well be adapted to be displaced along a track which is provided on the floor or on the lay-out table. The gripping means need not necessarily be attached to a telescopic carrier, but it may be received in some other type of guide means, provided that this is desired at all. Finally, the frames may have a different structural design and can, for example, be designed as rectangular frames and square frames, respectively, or only as transverse struts connected by bow means (first frame) and longitudinal struts connected by bow means (second frame). Nor is it absolutely indispensable to provide a gripping means 4, but such gripping means will essentially facilitate work carried out by the device according to the invention. Furthermore, said gripping means 4 can be structurally varied, e.g. by providing only one bent lever and three rotary plates, in which case the rotary plate provided with the bent lever will entrain the oppositely disposed rotary plates by contact therewith and move them to a position permitting unloading.

What is claimed is:

1. A device for winding or unwinding a web of material with respect to a winding shaft, comprising an elongated stationary support structure, a frame movable longitudinally with respect to said support structure, suspension means on said frame for supporting said winding shaft and driving means, comprising at least two first guide rolls supported on said frame, being arranged on both sides of said winding shaft, rope means, having a first and a second end, said first end being fixed with respect to said movement of said frame, and said second end being connected to tensioning means for holding said rope means under tension, said rope means between said first and said second end contacting at least a part of said guide rolls and the web wound on said winding shaft, said rope means also being in frictional engagement with said wound web, said rope means further being adapted to being displaced in the direction of the circumference of said guide rolls and said web when said frame is moved relative to said support means in order to rotate said wound web on said winding shaft for winding or unwinding said web.

2. A device according to claim 1, wherein the drive means is preceded by two second guide rolls, which are arranged such that they are disposed one behind the other on the frame and spaced-apart from the winding shaft wound with the web.

3. A device according to claim 2, wherein the second guide rolls are circumferentially spaced from each other at a distance which is essentially equal to, or slightly greater than twice the thickness of the rope.

4. A device according to claim 2, wherein said second guide rolls are stationary relative to a turning movement of said drive means around a vertical axis.

5. A device for winding or unwinding a web of material with respect to a winding shaft, comprising an elongated stationary support structure, a frame movable longitudinally with respect to said support structure, suspension means on said frame for supporting said winding shaft and driving means, comprising at least two first guide rolls supported on said frame, being arranged on both sides of said winding shaft, a frictional wheel adapted to being rotated by said movement of said frame, and an endless rope means under tension contacting at least part of said frictional wheel, said guide rolls and the web wound on said winding shaft, said rope means being in frictional engagement with said frictional wheel and said wound web, said rope means further being adapted to being displaced in the direction of the circumference of said guide rolls and said web when said frictional wheel is rotated by the movement of said frame relative to said support means in order to rotate said wound web on said winding shaft for winding or unwinding said web.

6. A device according to claim 1 or 5, including means for pivoting the first guide rolls into and out of engagement with said web wound on said winding shaft.

7. A device according to claim 6, wherein the means for pivoting includes a system of levers.

8. A device according to claim 1 or 5, wherein each of the first guide rolls is suspended from a freely pivotable pivot lever and that said first guide rolls are adapted to be pivoted into contact with said web wound on said winding shaft due to the force of gravity and away from said web wound on said winding shaft with the aid of a displacement means.

9. A device according to claim 1 or 5, wherein the drive means is adapted to be turned by at least 180° around a vertical axis extending at right angles to the direction of movement of the frame resulting in crossing of the rope.

10. A device according to claim 9, wherein the frame comprises an arcuate rail means, and that the drive means cooperates with said rail means via rollers.

11. A device according to claim 10, wherein said rail means forms a closed circle.

12. A device according to claim 9, wherein said frame comprises first and second frames.

13. A device according to claim 12, wherein the first frame carries rollers which are in engagement with longitudinal rails, and arcuate rail means.

14. A device according to claim 12, wherein the second frame carries said suspension means for said winding shaft as well as the first guide rolls.

15. A device according to claim 1 or 5, wherein said suspension means for said winding shaft also includes bearing means for rotatably receiving therein said winding shaft.

16. A device according to claim 15, wherein the bearing means, which is designed as a gripping means, is attached to the lower, free end of a suspension carrier adapted to be extended downwards in the fashion of a telescope.

17. A device according to claim 16, wherein the suspension carrier is provided with a slot, which extends at least from the lower end of said suspension carrier and whose width is equal to or greater than the diameter of the winding shaft, wherein the bearing means is divided into two parts, one part being arranged on each side of the slot, and that at least one part of the bearing means is adapted to be transversely displaced relative to said suspension carrier in such a way that the distance between the parts of the bearing means is smaller than the diameter of the winding shaft in a first position and larger than said diameter in a second position.

18. A device according to claim 17, wherein said bearing means comprises two oppositely disposed rotatable rolls, the axle of one of said rotatable rolls being displaceably supported in an elongate opening at both sides thereof, said elongate opening extending away from the carrier slot at an oblique angle upwards and outwards in such a way that the first position is determined by the point at which the axle of the rotatable roll abuts the lower end of the elongate opening.

19. A device according to claim 18, wherein the elongate opening is provided in a plate member which is rotatably connected to the suspension carrier and which is adapted to be locked, at least one plate member being designed as a two-armed bent lever and said two-armed bent lever having provided in one of its arms said elongate opening and being adapted to be pivoted about an axle, which is arranged in said arm, in such a way that the other arm of said bent lever projects into the carrier slot above the winding shaft at least in the first position of the bearing means.

20. A device according to claim 19, wherein by means of a spring secured in position on the suspension carrier, the bent lever is spring-loaded such that the other arm projects into the carrier slot while the roll axles abut on the lower end of the elongate opening and the other arm is retracted from the carrier slots, and that, in a second end position, the elongate openings extend essentially in the horizontal direction.

21. A device according to claim 15, including longitudinal rails for the longitudinal movement of the frame, and wherein on both sides adjacent the longitudinal rails there is provided a parallel extending longitudinal rail, second suspension means having a point of support for the winding shaft of the web running on each of said parallel extending longitudinal rails.

22. A device according to claim 21, wherein the second suspension means is adapted to be entrained by the winding shaft when the web wound on said winding shaft is moved longitudinally.

23. A device according to claim 22, wherein the point of support is arranged in perpendicularly spaced relationship with the winding shaft, which is received in the first suspension means, and is designed as a hook whose free end is longer than this distance.

24. A device according to claim 5, wherein the frictional wheel and the winding shaft have provided between them additional guide rolls for the rope which are arranged in pairs one behind the other.

25. A device according to claim 24, wherein the frictional wheel is secured in position relative to the turning movement of the drive means around the vertical axis.

* * * * *